United States Patent [19]

Witting

[11] Patent Number: 4,902,937

[45] Date of Patent: Feb. 20, 1990

[54] CAPACITIVE STARTING ELECTRODES FOR HID LAMPS

[75] Inventor: Harald L. Witting, Burnt Hills, N.Y.

[73] Assignee: General Electric Company, Schenectady, N.Y.

[21] Appl. No.: 225,315

[22] Filed: Jul. 28, 1988

[51] Int. Cl.[4] ..... H05B 41/16

[52] U.S. Cl. ..... 315/248; 315/267

[58] Field of Search ..... 315/248, 39, DIG. 5, 315/DIG. 7, 149, 158, 241, 224; 313/606–609, 601

[56] References Cited

U.S. PATENT DOCUMENTS

| | | | |
|---|---|---|---|
| 2,300,916 | 11/1942 | Furedg | 315/248 |
| 2,602,914 | 7/1952 | Schlesman et al. | 315/248 |
| 3,989,983 | 11/1976 | Uchino et al. | 315/248 |
| 4,041,352 | 8/1977 | McNeill et al. | 315/248 |
| 4,176,296 | 11/1979 | Anderson | 315/248 |
| 4,298,828 | 11/1981 | Justice et al. | 315/248 |
| 4,480,213 | 10/1984 | Lapatovich et al. | 315/248 |

FOREIGN PATENT DOCUMENTS

| | | | |
|---|---|---|---|
| 0004379 | 1/1978 | Japan | 315/248 |
| 161361 | 12/1980 | Japan | 315/248 |

*Primary Examiner*—Leo H. Boudreau
*Assistant Examiner*—Michael Razavi
*Attorney, Agent, or Firm*—Geoffrey H. Krauss; James C. Davis, Jr.; Marvin Snyder

[57] ABSTRACT

A pair of starting electrodes are provided for an electrodeless high-intensity-discharge lamp arc of the type having an envelope situated within the bore of an excitation coil and in the interior of which envelope is to be provided a plasma arc discharge driven by the excitation coil. Each of the starting electrodes is a conductive ring disposed adjacent to an associated one of an opposed pair of envelope surfaces, and connected to an opposite end of the excitation coil. A high-voltage signal coupled between the starting electrodes causes an electric field to be produced sufficient to create a glow discharge in the arc tube, and cause an almost instantaneous transition to a high-current solenoidal discharge to form the discharge plasma responsive to the normal field provided by the excitation coil.

13 Claims, 2 Drawing Sheets

CAPACITIVE STARTING ELECTRODES FOR HID LAMPS

BACKGROUND OF THE INVENTION

The present invention relates to electrodeless high-intensity-discharge (HID) lamps and, more particularly, to novel electrodes for initiating a plasma discharge within the arc space of the electrodeless HID lamp.

It is now well known to provide a toroidal light-emitting plasma within the envelopes of a HID lamp. The induction arc plasma depends upon a solenoidal, divergence-free electric field for its maintenance; the field is created by the changing magnetic field of an excitation coil, which is typically in the form of a solenoid. It is necessary to develop a very high electric field gradient across the arc tube to start the plasma discharge; it is difficult to develop a sufficiently high electric field gradient, especially in the associated excitation coil, because the coil current may be prohibitively high, even if it is to be provided only on a pulse basis. Further, providing a very high electric field gradient may be impossible because the necessary field-per-turn of the excitation coil may exceed the turn-to-turn electrical breakdown rating of that coil. Thus, it is difficult to provide some means for starting induction-driven HID lamps, and it is also difficult to provide for hot restarting of the same type of lamp. It is therefore highly desirable to provide some means for starting the HID lamp plasma discharge, which starting means can be easily utilized with typically HID lamps, under normal ambient conditions.

BRIEF SUMMARY OF THE INVENTION

In accordance with the invention, an electrodeless high-intensity-discharge lamp, having an envelope situated within the bore of an excitation coil and in the interior of which envelope is to be provided a plasma arc discharge driven by the excitation coil, is provided with a pair of starting electrodes each of which is a conductive ring disposed adjacent to an associated one of an opposed pair of envelope end surfaces, and connected to an opposite end of the excitation coil. Coupling of a high-voltage signal between the pair of starting electrodes causes an electric field to be produced between the pair of electrodes, of magnitude and position sufficient to cause the material within the lamp envelope to create a glow discharge in the arc tube, due to the arc tube wall capacitance. The glow discharge creates enough ionization in a suitable location so that an almost instantaneous transition to a high-current solenoidal discharge will occur and form the discharge plasma responsive to the normal field provided by the excitation coil.

In presently preferred embodiments, the ring shape of each capacitive starting electrode is broken, preferably over an arcuate section opposite to that section of the ring electrode connected to the associated excitation coil end, to prevent the ring electrode from acting as a single-turn secondary coil having high circulating currents. Bimetallic means for moving the starting electrodes away from the discharge tube, responsive to receipt of thermal energy released therefrom, can be utilized to extend the discharge tube useful life.

Accordingly, it is an object of the present invention to provide novel capacitive starting electrodes for an electrodeless high-intensity-discharge lamp.

This and other objects of the invention will become apparent upon reading the following detailed description, when considered in conjunction with the drawings.

DETAILED DESCRIPTION OF THE INVENTION

Figure 1A:
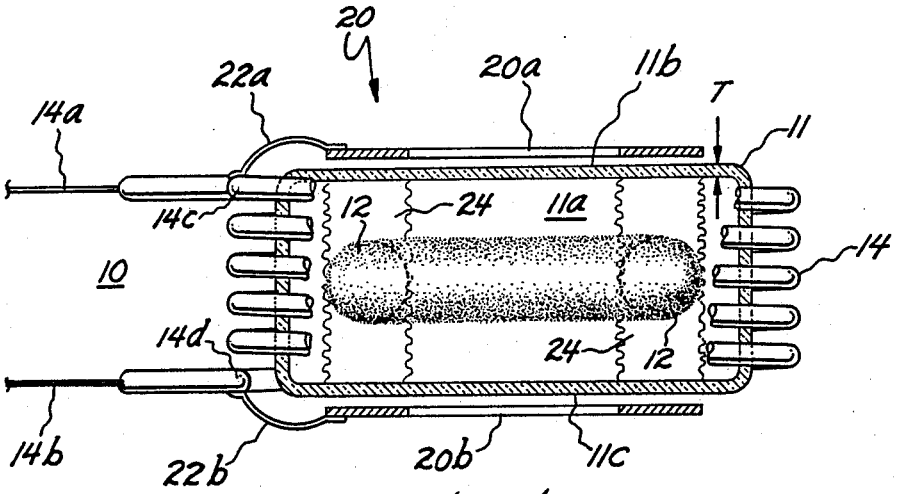
FIGS. 1*a* and 1*b* are respective side and top views of an electrodeless HID lamp, an excitation coil therefore, and a first embodiment of novel capacitive starting electrodes in accordance with the invention.
Figure 1B:
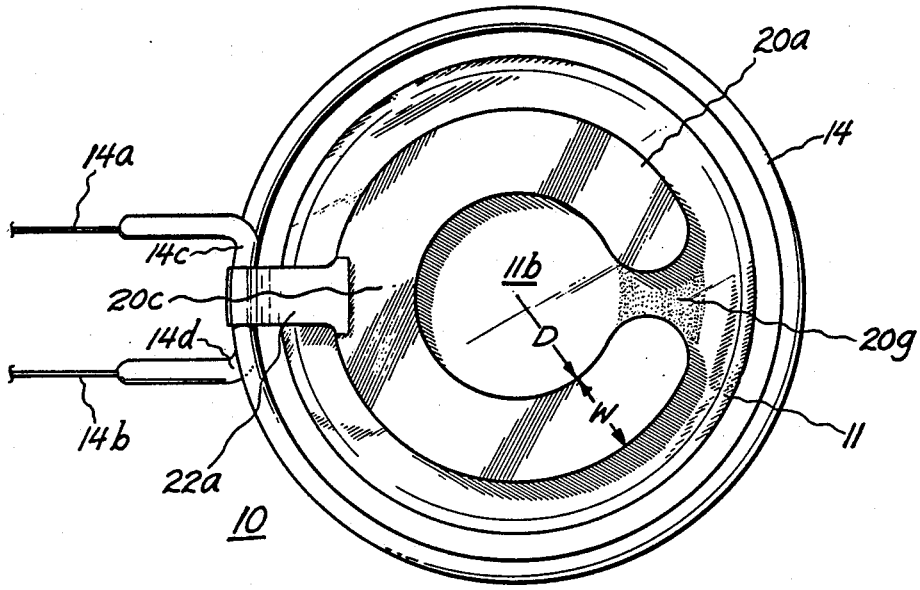

Referring initially to FIGS. 1*a* and 1*b*, an induction, or electrodeless, high-intensity-discharge (HID) lamp 10 comprises an arc tube, or envelope, 11 having a substantially cylindrical shape, enclosing a substantially gaseous material 11*a* including a starting gas, such as argon, xenon, krypton and the like, and a metal halide, such as sodium iodide, cerium iodide and the like. A substantially toroidal arc discharge 12 is to be generated and then maintained within envelope 11 by an electric field generated by an excitation coil 14, responsive to a radio-frequency (RF) signal applied between the opposite coil ends 14*a* and 14*b*. Envelope 11 is positioned with its axis generally along the axis of coil 14.

In accordance with one aspect of the invention, each of a pair of starting electrodes 20*a* and 20*b* are provided as a generally ring-shaped conductive member located adjacent to the exterior of the top and bottom surfaces 11*b* and 11*c* of the arc tube, and each extending in a plane substantially parallel to the adjacent surface, and thus generally perpendicular to the substantially-mutual axis of envelope 11 and coil 14. A central section 20*c* of each ring member 20*a* and 20*b* is connected, by a conductive member 22*a* or 22*b*, respectively, to an adjacent section 14*c* or 14*d*, respectively, of the excitation coil, respectively adjacent to one of the opposite ends 14*a* or 14*b* thereof. As each of ring-shaped conductive members 20*a* or 20*b* is within the electric field, a gap portion 20*g* thereof is removed to prevent a formation of a completed turn, so that the ring member does not form a secondary coil having a high circulating current therein. Advantageously, the gap portion 20*g* is positioned substantially opposite to the portion 20*c* at which conductive member 22*a* or 22*b* is attached to the ring member 20*a* or 20*b*, respectively; so positioning gap portion 20*g* tends to balance the mass of the ring member 20 with respect to the conductive portion 22; this balance may be important for movement purposes, as will become more apparent in the embodiment to be discussed hereinbelow with respect to FIGS. 2*a* and 2*b*.

The starting members 20 are each located in close proximity to the exterior surface of the arc tube, but do not have to be in contact with the envelope. Responsive to a high voltage and current (on the order of 2500 V and 15 A), applied to excitation coil 14, a high voltage is applied across the arc tube 11 from upper starting electrode 20*a* to lower starting electrode 20*b*, forming a ring-shaped glow discharge region 24. The glow discharge volume 24 generates enough ionization, in a very favorable location with respect to the desired discharge plasma toroid 12, so that transition to the high-current plasma arc discharge occurs almost instantaneously. The magnitude of the capacitive current across the wall of arc tube 11 can be estimated by assuming that the capacitive starting aid ring members have an interior diameter D of about 14 millimeters, a width W of about 1 millimeter and have a total area of about 47 square millimeters. If the arc tube wall has a thickness T of about 1 millimeter and is made of quartz with a dielectric constant $\epsilon_r=3.8$ at 13.56 MHz., then the capacitance across each arc tube wall can be calculated to be about 1.6 picofarads. With about 1000 V, at 13.56 MHz., applied across each arc tube wall, the capacitive current is about 140 mA. Such a high current level significantly aids the starting process. It should be noted that conductive members 22 may be removed or replaced with insulative members and the capacitive starting aid members 20 then connected to a separate RF power supply, rather than to the excitation coil 14, for application of high voltage. A separate power supply does not have to operate at the same frequency as the excitation coil, and may be energized only during the starting process. A separate starting supply allows more flexibility in the design of excitation coil 14 and the RF power source (not shown) therefore, although such a separate starting supply may add to the cost and complexity of the lamp-driving circuitry.

It will be seen, however, that the stationary generally-ring-shaped starting members 20 have several disadvantages: being in close proximity to arc tube 11, starting electrodes 20 interfere with temperature control of the arc tube and block light emission therefrom; and may cause early lamp degradation due to ion bombardment of arc tube 11 from the continuous capacitive currents flowing even during normal lamp operation. To alleviate the foregoing disadvantages, the presently preferred embodiment 10' of FIGS. **2*a* and 2*b* utilizes moveable capacitive starting electrodes 30. Thus, the start-aiding electrodes are removed from the vicinity of arc tube 11' after the lamp has started, so that the starting aids do not: substantially block light emission; interfere with the thermal balance of arc tube 11'; or contribute to lamp degradation. It will be seen that HID lamp 10' has arc tube envelope 11' containing substantially gaseous material 11'*a*. Envelope 11' has top and bottom surfaces 11'*b* and 11'*c*, and may be formed with a slanted periphery portion 11'*d*, to have a lozenge-shaped cross-section. The multi-turn excitation coil 14'** is here shown as being a non-solenoidal, toroidal excitation coil with V-shaped cross-section, as previously disclosed in copending U.S. application Ser. No. 138,005, now U.S. Pat. No. 4,812,702 filed on Dec. 28, 1987, and incorporated here in its entirety by reference.

It will be seen that the upper and lower capacitive starting electrodes **30*a* an 30*b* can be formed to have a cross-section which allows the conductive gapped-ring members to be closely adjacent to the top and bottom exterior surfaces of the envelope. Thus, for a lozenge-cross-section envelope 11', the members 30** have a shallow conical-band shape. Similarly, it will be understood that other cross-sectional shapes can be utilized with arc tubes having other cross-sectional configurations.

Figure 2A:
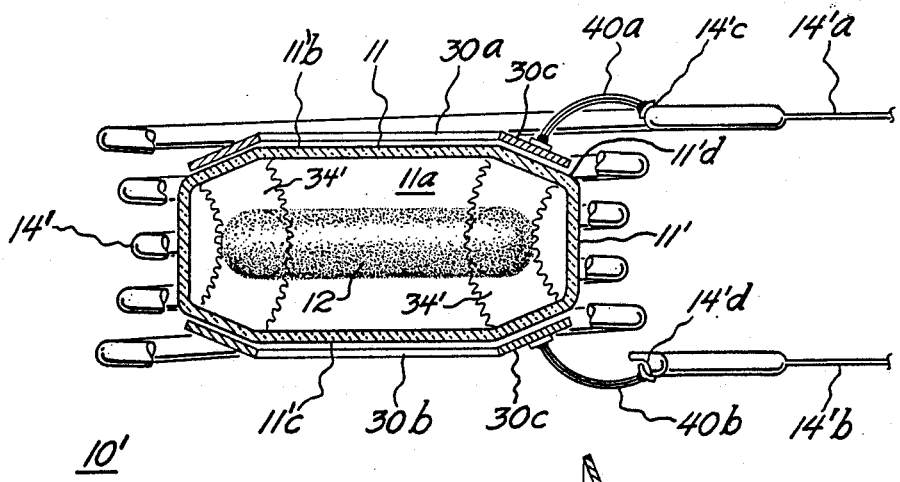
FIGS. 2*a* and 2*b* are side views of another presently preferred embodiment of capacitive starting electrode, for use with a HID lamp and excitation coil therefore, and illustrating the respective cold starting position and hot operating position thereof.
Figure 2B:
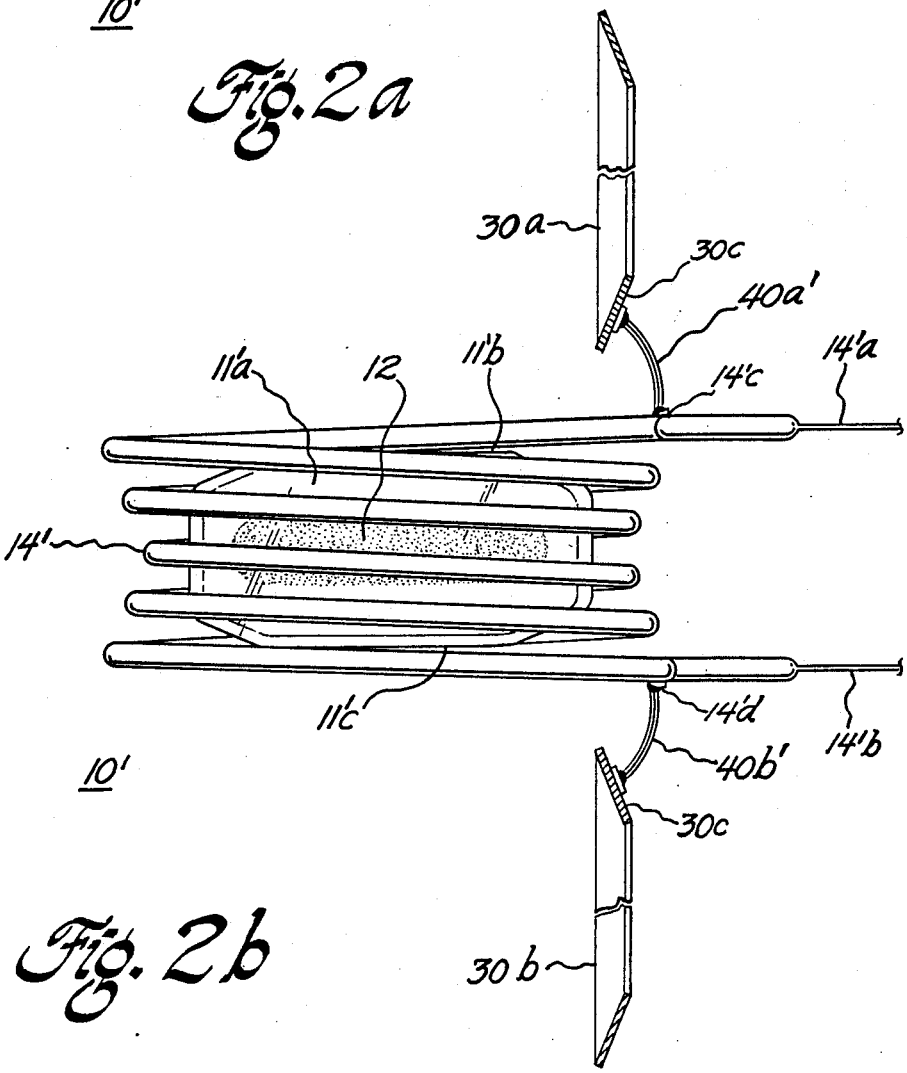

In accordance with another aspect of the invention, conductive attachments **40*a* and 40*b*, connecting the starting element central sections 30*c* to adjacent attachment points 14'*c* or 14'*d* of the excitation coil, are heat-sensitive, e.g. bimetallic, strips so formed as to be suitable curved, as seen in FIG. 2*a*, at normal ambient temperatures, to cause starting electrodes 30 to lie adjacent to the lamp envelope 11' surface. The glow discharge regions 34' will thus be formed when the coil 14' is initially energized, and will aid in starting the arc plasma discharge torus 12 within the envelope. Responsive to heat energy emitted from the operating lamp, the bimetallic strips undergo differential expansion and change the curvature thereof, so that the strips 40*a'* and 40*b'* move starting electrodes 30*a* and 30*b* away from the arc tube, as shown in FIG. 2*b*. It will be understood that when the lamp is turned off, bimetallic connection members 40 cool down and return to the starting position of FIG. 2*a*. One exemplary movable capacitive starting aid embodiment utilized 10 milli-inch thick stainless steel foil members 30** attached to 7 milli-inch thick bimetal foils available as catalog number PMC223-1 from Polymetallurgical Corp. of Attleboro Falls, Mass. The ends of the bimetallic foil not attached to the stainless steel gapped-ring electrodes were mounted to the associated end of a 10-turn V-shaped excitation coil formed of one-eighth inch diameter copper tubing. Repeated starting of a HID lamp, containing cerium and sodium iodides and a krypton buffer gas at 250 Torr, occurred with application of 13.56 MHz. currents of 10A or less to the coil. After lamp operation had started, the starting aids moved well away from the arc tube in less than one minute. After lamp operation ceased, the starting aids slowly moved back to the starting position, allowing subsequent restart of the lamp.

While several presently preferred embodiments of my novel invention have been described in detail herein, it will now become apparent that many modifications and variations can be made by those skilled in the art. It is my desire, therefore, to be limited only by the scope of the appending claims and not by the specific details and instrumentalities presented by way of explanation herein.

What I claim is:

1. Starting electrodes for an electrodeless high-intensity-discharge (HID) lamp of the type having an arc tube situated within the bore of an RF excitation coil and within which arc tube a plasma arc discharge is to be formed and driven by the excitation coil, comprising:

a pair of starting electrodes, each positioned, at least during commencement of the plasma arc discharge, adjacent to the exterior surface of an associated one of a pair of opposed surfaces of the arc tube, said starting electrodes not substantially driving said plasma arc discharge, and at least one of the starting electrodes having a cross-sectional shape selected to be a conical section substantially similar to the shape of the exterior arc tube surface adjacent to which that electrode will be located at least during plasma arc discharge commencement; and means for coupling a high-voltage starting signal between the pair of starting electrodes to cause creation, at least at said plasma arc discharge commencement, of a glow discharge within the arc tube due to capacitive current flow therethrough from said starting electrodes.

2. The starting electrodes of claim 1, wherein at least one of said electrodes is a substantially ring-shaped conductive member.

3. The starting electrodes of claim 2, wherein each ring-shaped electrode has a gap portion therein, devoid of conductive material.

4. The starting electrode of claim 1, wherein said coupling means comprises a conductive member connecting a selected portion of the electrode to an adjacent portion of the excitation coil.

5. The starting electrode of claim 4, wherein the conductive member connects the electrode to an adjacent end portion of the excitation coil.

6. Starting electrodes for an electrodeless high-intensity-discharge (HID) lamp of the type having an arc tube situated within the bore of an RF excitation coil and within which arc tube a plasma arc discharge is to be formed and driven by the excitation coil, comprising:

a pair of starting electrodes, at least one of said electrodes being a substantially ring-shaped conductive member with each ring-shaped electrode having a gap portion therein devoid of conductive material, each starting electrode positioned, at least during commencement of the plasma arc discharge, adjacent to the exterior surface of an associated one of a pair of opposed surfaces of the arc tube, said starting electrodes not substantially driving said plasma arc discharge; and means for coupling a high-voltage starting signal between the pair of starting electrodes to cause creation, at least at said plasma arc discharge commencement, of a glow discharge within the arc tube due to capacitive current flow therethrough from said starting electrodes.

7. Starting electrodes for an electrodeless high-intensity-discharge (HID) lamp of the type having an arc tube situated within the bore of an RF excitation coil and within which arc tube a plasma arc discharge is to be formed and driven by the excitation coil, comprising:

a pair of starting electrodes, each positioned, at least during commencement of the plasma arc discharge, adjacent to the exterior surface of an associated one of a pair of opposed surfaces of the arc tube, said starting electrodes not substantially driving said plasma arc discharge; and means for coupling a high-voltage starting signal between the pair of starting electrodes to cause creation, at least at said plasma arc discharge commencement, of a glow discharge within the arc tube due to capacitive current flow therethrough from said starting electrodes and, responsive to establishment of said discharge, for moving the starting electrodes to a location further from said arc tube than the location of the electrodes during discharge commencement.

8. The starting electrodes of claim 7, wherein said moving means comprises means for moving the starting electrodes responsive to receipt of heat energy from said arc tube.

9. The starting electrodes of claim 8, wherein said heat-energy-responsive moving means is adapted to move the starting electrodes back toward the arc tube responsive to cessation of receipt of heat energy from said arc tube.

10. The starting electrodes of claim 9, wherein the moving means comprises a conductive flexible member connecting a selected portion of each electrode to an object substantially fixedly positioned with respect to the arc tube.

11. The starting electrodes of claim 10, wherein the object is the excitation coil.

12. The starting electrodes of claim 11, wherein said flexible conductive member is a bimetallic member.

13. The starting electrodes of claim 9, wherein said flexible conductive member is a bimetallic member.

* * * * *